US007692097B2

(12) United States Patent
King, Jr. et al.

(10) Patent No.: US 7,692,097 B2
(45) Date of Patent: Apr. 6, 2010

(54) DIP MOLDED WIRE CONNECTOR

(76) Inventors: L. Herbert King, Jr., 394 Larimore Valley Dr., Chesterfield, MO (US) 63005; Michael Belgeri, 1007 Bridgeport, Ellisville, MO (US) 63011; James Keeven, 2641 Whitetail La., O'Fallon, MO (US) 63366

( * ) Notice: Subject to any disclaimer, the term of this patent is extended or adjusted under 35 U.S.C. 154(b) by 92 days.

(21) Appl. No.: 11/349,029

(22) Filed: Feb. 7, 2006

(65) Prior Publication Data

US 2006/0169476 A1 Aug. 3, 2006

Related U.S. Application Data

(62) Division of application No. 10/928,671, filed on Aug. 26, 2004, now Pat. No. 7,086,150.

(51) Int. Cl.
*H01R 4/00* (2006.01)

(52) U.S. Cl. ..... 174/87

(58) Field of Classification Search ..... 174/87; 439/415

See application file for complete search history.

(56) References Cited

U.S. PATENT DOCUMENTS

| | | | | |
|---|---|---|---|---|
| 4,751,350 | A * | 6/1988 | Eaton | 174/87 |
| 4,803,779 | A * | 2/1989 | Blaha | 29/878 |
| 5,705,773 | A * | 1/1998 | Smith | 174/75 B |
| 5,772,462 | A * | 6/1998 | Osten | 439/367 |
| 6,478,606 | B1 * | 11/2002 | McNerney et al. | 439/415 |
| 7,037,128 | B2 * | 5/2006 | Yaworski et al. | 439/276 |
| 2002/0050387 | A1 * | 5/2002 | Blaha et al. | 174/87 |
| 2002/0066588 | A1 * | 6/2002 | King, Jr. | 174/87 |

* cited by examiner

*Primary Examiner*—Chau N Nguyen
(74) *Attorney, Agent, or Firm*—Jacobson & Johnson

(57) ABSTRACT

A connector with a dip-molded housing and a method for forming a twist-on wire connector with a dip-molded housing. To dip-mold a covering or housing on a twist-on wire connector either a mandrel carrying a twist-on wire coil, a mandrel having the a shape of a spiral coil or a twist-on wire connector are dipped into a bath of an in situ solidfiable dip-moldable material such as liquid plastic. The dip-moldable solidified material solidifies to form a dip-molded shell on the wire connector.

8 Claims, 4 Drawing Sheets

DIP MOLDED WIRE CONNECTOR

CROSS REFERENCE TO RELATED APPLICATIONS

This application is a division of application Ser. No. 10/928,671 filed on Aug. 26, 2004 now U.S. Pat. No. 7,086,150.

FIELD OF THE INVENTION

This invention relates generally to wire connectors and more specifically to twist-on wire connectors having a dip-molded shell to provide enhanced impact resistance through in-situ formation of the dip-molded shell. In one embodiment the dip-molded shell carries a twist-on wire coil and in another embodiment the dip-molded shell encapsulates the exterior surface of a rigid housing of a twist-on wire connector.

STATEMENT REGARDING FEDERALLY SPONSORED RESEARCH OR DEVELOPMENT

None

REFERENCE TO A MICROFICHE APPENDIX

None

BACKGROUND OF THE INVENTION

The concept of dip-molding coverings or hollow shells for tool handles to provide a soft hand grip is well known in the art. An example of dip-molding using a mandrel is shown in U.S. Pat. No. 4,695,241 wherein an internal passage is provided so that a hollow part can be dip-molded. Still another example of dip-molding to form an electrical socket is shown in U.S. Pat. No. 5,350,318 wherein a wire lead is wrapped around a projection to form a socket and the wire lead and the projection are coated with a layer of plastisol.

In the formation of twist-on wire connectors one places a hard or rigid shell around a twist-on wire connector. To form a twist-on wire connector one forms a cavity and then injection molds plastic into the cavity to form a hollow shell for supporting a wire coil therein. A method of making twist-on wire connector is shown in King U.S. Pat. No. Re37340 and King U.S. Pat. No. 5,151,239 which shows the formation of an injection molded shell around the exterior of the twist-on wire connector by first forming a mold cavity and placing the twist-on wire connector in the cavity and then injecting a moldable plastic into the mold cavity to form an injection molded shell around the twist-on wire connector.

An example of a twist-on wire connector with a hard shell surrounding the spiral wire coil and a soft sleeve engaging a portion of the shell is shown in the U.S. Patent Application Publication 2002/0050387. The Publication shows six different sleeves which are separately formed and then placed around a portion of the exterior surface of a twist-on wire connector for the purpose of forming a cushion grip on the twist-on wire connector. In another embodiment U.S. Patent Application Publication 2002/0050387 a portion of the twist-on wire connector is over molded with a softer material to provide a cushion grip on a portion of the twist-on wire connector. While these inventions are for the purposes of providing a soft grip they do not address the problem of making the twist-on wire connector with enhanced impact resistance.

In contrast to the above art, the present invention provides a method for forming a twist-on wire connector with enhanced impact resistance. That is, to prevent the wires from coming loose from the twist-on wire connectors the inclusion of a dip-molded shock absorber covering on the twist-on wire connector provides enhanced impact resistance that inhibits wires from coming loose in the twist-on wire connector as well as cracking to protect from dielectric failure. A twist-on wire connector can be formed without the aid of a mold through a dip-molding process. In another method a twist-on wire connector is dipped into a bath of a dip-molding compound that solidifies in-situ. Dip-molding compounds include vinyl compound such as plastisol. The dip-moldable materials which can be in liquid or gel form surrounds the exterior surfaces of the twist-on wire connector. As the dip-molding compound cools around the connector it provides an in-situ formation of an impact resistance covering or shell on the outside of the exterior surface of twist-on wire connector to provide a soft-to-the-touch dip-molded shell that has enhanced impact resistance.

In another method a twist on wire connector spiral coil is placed on the end of a mandrel and dipped into a mold of liquid plastic. The liquid plastic is allowed to solidify around the mandrel to provide for an in-situ formation of an impact resistance shell around the mandrel. The mandrel is then removed leaving the spiral coil in the shell.

In still another method the mandrel is provided with a shape of a spiral coil and is dipped in a vat of liquid plastic to form a covering around the mandrel. The mandrel is then removed and the covering is allowed to solidify for in-situ formation of a shell. In the next step a spiral coil is inserted into the dip-molded shell to form a twist-on wire connector with an impact resistance shell.

In still another method the mandrel with a set of fins is dipped into the vat of dip-moldable material while the dip-moldable material is allowed to flow inward to form an integral cover on the housing with the integral cover having flexible portions to allow removal of the mandrel after the solidification of the dip-moldable material about the mandrel.

SUMMARY OF THE INVENTION

A twist-on-connector with a dip-molded housing and a method for forming a twist-on wire connector with a dip-molded housing. To dip-mold a covering or housing on a twist-on wire connector either a mandrel carrying a twist-on wire coil, a mandrel having the shape of a spiral coil or a twist-on wire connector are dipped into a bath of an insitu solidifiable dip-moldable material such as liquid plastic. The dip-moldable material solidifies to form a dip-molded shell having enhanced impact resistance. In a further embodiment an end portion of a mandrel is allowed to be partially covered with dip-moldable material to enable the in situ formation of an integral cover on the housing of the wire connector.

DESCRIPTION OF THE PREFERRED EMBODIMENT

Figure 1:
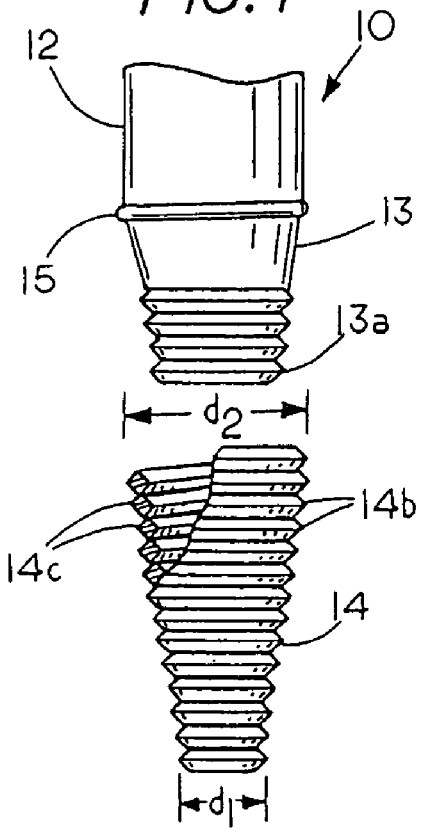
FIG. 1 is a side view of a twist-on wire coil and a mandrel for engaging the wire coil.

FIG. 1 is an elevation view of a mandrel 10 having a hanger bar 12 for raising and lower the mandrel 10 into a vat of dip-moldable material such as a vat of liquid plastic 20. Mandrel 10 includes an annular bead 15, that is, an annular cover forming ridge 15 on the mandrel 10 that extends radially outward around the top portion of cylindrical mandrel housing 13. Annular cover forming ridge 15 is used for those twist-on wire connectors that have a separate end cap that is secured to the housing 13. If no end cap is used or if a non-insertable end cap is used cover forming ridge 15 need not be used. Mandrel 10 terminates in a frusto conical tip having an exterior surface with a male spiral thread 13*a*. Positioned beneath mandrel 10 is a wire coil 14 that has an interior surface with a female spiral thread 14*c* and an exterior surface with a male spiral thread 14*b*. The wire coil 14 comprises a spiral threaded wire coil with a maximum diametrical top dimension $d_2$ that is larger than an apex diametrical dimension $d_1$. While a spiral wire coil, which has an internal female thread and an external male thread is shown as the preferred wire engaging member of a twist-on wire connector other types of wire connector inserts having rotationally wire engageable members can also be used in the present invention.

Wire coil 14 is of the type used in twist-on wire connectors and generally includes wires with a rectangular cross section and an internal female spiral thread 14*c* which can draw wires into tight engagement with each other as the wire coil is rotated with respect to wire ends located therein.

Figure 2:
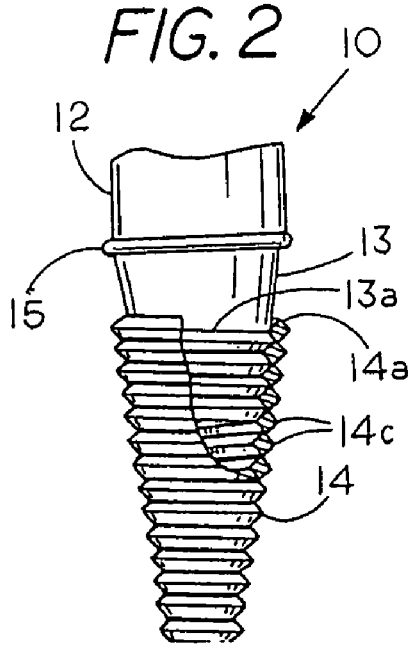
FIG. 2 shows a partial sectional view with the twist-on wire coil and mandrel of FIG. 1 in engagement with each other.

FIG. 2 shows the mandrel 10 with the male spiral thread 13*a* engaging the female spiral thread 14*c* to frictionally hold the wire coil 14 on spiral thread 13*a* of mandrel 10. In this position the mandrel 10 and the wire coil 14 can be immersed in a bath of dip-moldable material as a unit to provide for in-situ formation of a shell or housing around the wire coil 14.

Figure 3:
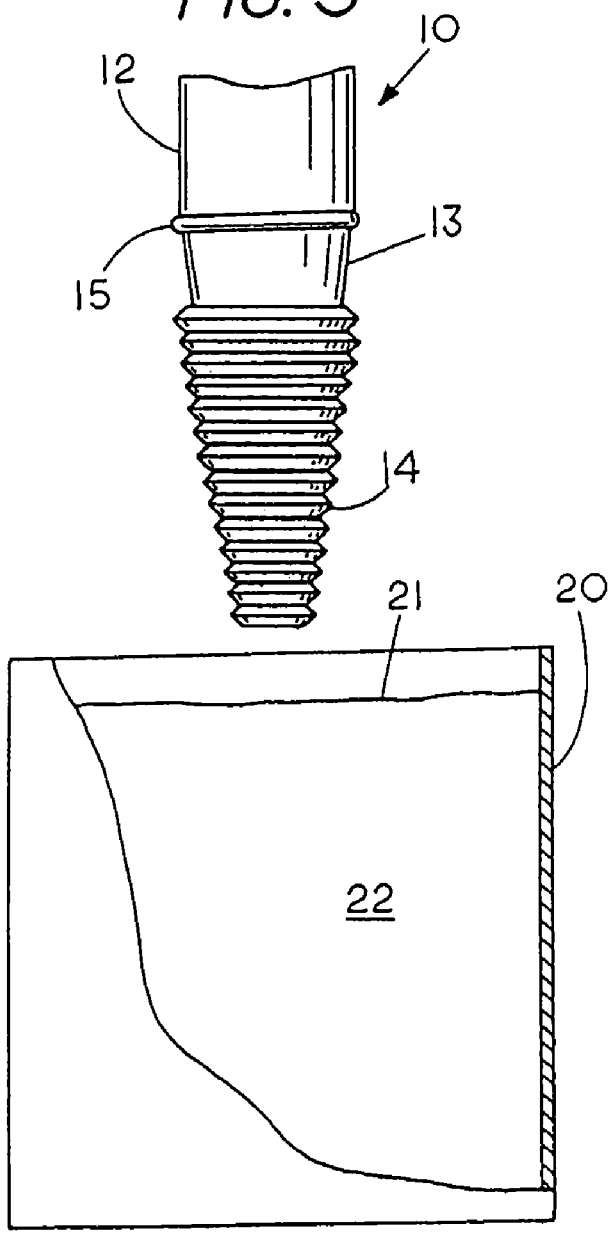
FIG. 3 is an elevation view of a mandrel and twist-on wire coil of FIG. 2 located above a vat of a dip-moldable material.

FIG. 3 shows a partial sectional view of vat 20 and mandrel 10 with the wire coil 14 frictional retained on mandrel 10 which is positioned above the vat 20 containing a liquid or gel of a dip moldable material 22. Examples of dip-moldable materials are vinyl compounds and in particular a compound known as plastisol. The interface surface between the atmosphere and the dip-mold is denoted by reference numeral 21.

Figure 4:
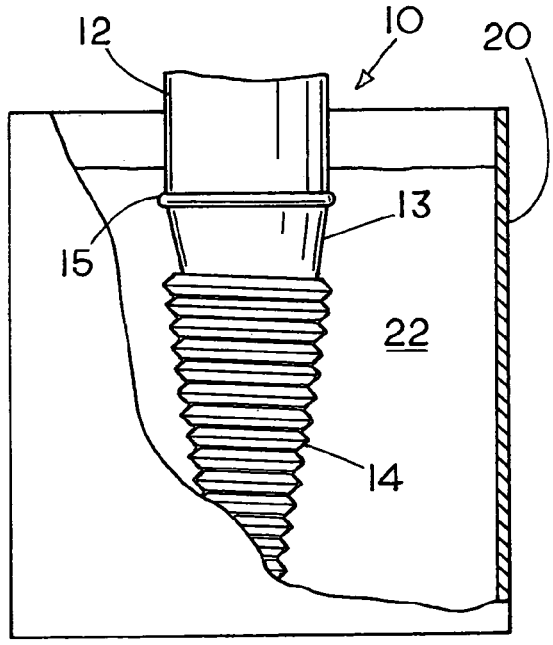
FIG. 4 shows the engaged mandrel and wire coil of FIG. 2 immersed in the vat of dip-moldable material.

FIG. 4 show the mandrel 10 lowered into the dip-moldable material 22 comprising plastisol to allow the flowable dip-moldable material to surround and adhere to the exterior surface 13 of both the mandrel 10 and the wire coil 14. The dip-moldable material 22 is allowed to congeal and form a shell or housing around the mandrel and the wire coil.

Figure 5:
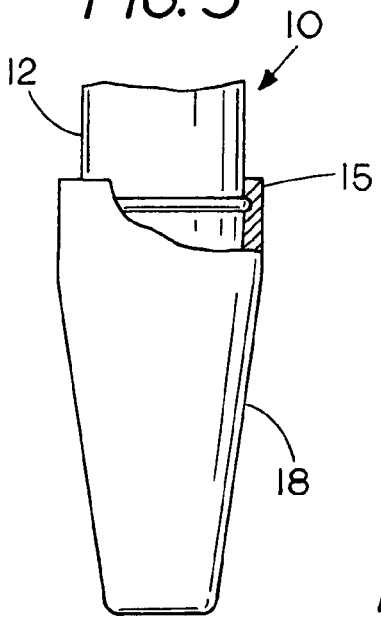
FIG. 5 shows the mandrel of FIG. 2 in a sectional view to reveal a coat of dip-moldable material forming a shell around the mandrel and wire coil.

FIG. 5 is a partial sectional view that shows the mandrel 10 after removal of the mandrel 10 from the dip-moldable material showing a coating or shell of dip-moldable material 18 encapsulating the mandrel below the ridge 15. In this process the dip-moldable material congeals and solidifies around the mandrel to provide for in-situ formation of a shell 18 that extends around the lateral and end surface of wire coil 14. Thus, FIG. 5 shows the mandrel 10 with the layer of dip-molded material in a solidified condition on the exterior surface of the mandrel.

Figure 6:
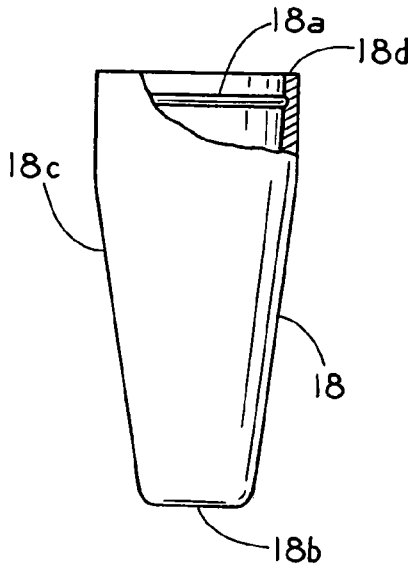
FIG. 6 is a partial sectional view of the dip-molded shell after the mandrel has been removed from the shell.

FIG. 6 is a partial sectional view that shows the in-situ formed shell or housing 18 after the mandrel 10 has been removed from the vat of dip-moldable material. In the embodiment shown the dip-molded housing 18 comprises an electrically insulated housing 18 that includes a circumferential surface 18*c* with a closed end surface 18*b* and an open end 18*d*. An annular recess 18*a* extends across the top portion of the shell for insertion of a cover or end cap therein.

Thus FIGS. 1-6 show the steps of in-situ forming an insulated shell through dip-molding with the twist-on wire connector having enhanced impact resistance. The process includes the steps of placing a spiral wire coil on a mandrel, dipping the mandrel with the spiral wire coil in a vat of dip-moldable material such as liquid plastic to form a plastic coating over the mandrel and the spiral wire coil, removing the mandrel and the spiral wire coil from the vat, allowing the liquid plastic to solidify around the mandrel and the spiral wire coil to thereby in-situ form a dip-molded shell around the mandrel and the spiral wire coil and removing the mandrel from the dip-molded shell while retaining the spiral wire coil in the dip-molded shell to thereby form a twist-on wire connector with the dip-molded shell forming an impact resistant external housing or shell on the spiral wire coil. By dip forming a shell in a vat of liquid plastic comprising plastisol one can form a shell that when solidified has a hardness in the range of 20 to 90 durometer and a thickness in the range of 0.010 inches to 0.250 inches.

If desired the dip-molding process can be done in multiple dippings and with multiple vats of dip-moldable material. For example, an outer layer of non-slip dip-moldable material can be applied to overlay another coating of dip-moldable material and thus provide enhanced user finger engagement with the housing through enhanced frictional characteristics. Similarly, layers of harder or softer material could be applied as a base coat or as an overlay coat to adapt the housing to so as to meet other field, environmental, or handling requirements.

Figure 3A:
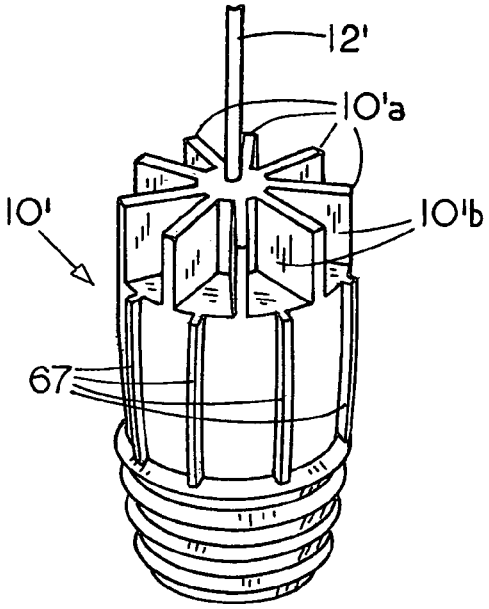
FIG. 3A shows a mandrel for use in molding an integral cap on the wire connector.

In a further embodiment of the invention air pockets 63 can be formed in the housing 60 by using internal ribs 67 on the mandrel 10 (FIG. 3A). That is, a set of circumferential spaced internal ribs 67 that extend along the exterior of the wire connector or within the dip-molded housing 60 can provide for an enhanced comfort grip since air in the pockets 63 formed by ribs 67 can compress more readily than the dip-moldable material.

In the embodiment of FIGS. 1 a mandrel 10 for forming a housing with a separate cap is shown. A reference to FIG. 3A shows a mandrel 10' for forming a housing with an integral dip-molded cap. That is a set of radial fins 10'*a* extend radially outward and longitudinally upward. A stem 12' permits dipping the mandrel into a vat of dip-moldable material. By immersing the mandrel until the dip-moldable material extends onto the radially fins 10*a*' one molds an integral end cover onto the housing. As the dip-moldable material is flexible the pie-shaped segments formed in the recess 10'*b* can flex upward to allow withdrawal of the mandrel from the dip-molded housing. When used with resilient dip-moldable material the radially inward extending pie-shaped segments 62 (FIG. 3B and 3C) will return to the inward extending position thereby providing an integral cover over the end of the housing formed in the dip-molding process.

Figure 3B:
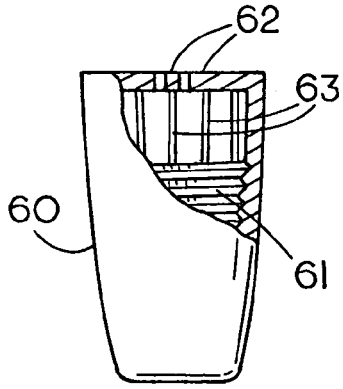
FIG. 3B shows a partial sectional view of a wire connector housing with a dip molded integral cap.

FIG. 3B shows a partial cross sectional view of a housing 60 with an integral dip-molded cap comprising radially extending pie shaped segments 62. The segments provide a wire access cover into the wire connector coil therein.

Figure 3C:
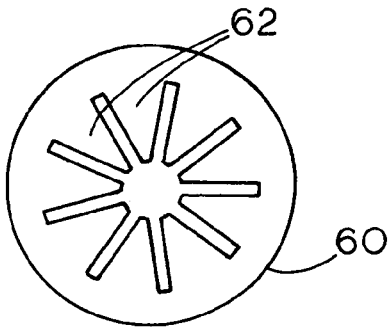
FIG. 3C shows a top view of a wire connector housing with a dip molded integral cap.

FIG. 3C shows a top view of the housing 60 with the radial extending pie shaped segments 62 providing a cover over the end of the housing with each of the segments separated by a space having a width that corresponds to the width of the fins 10'*a* of FIG. 3A.

Figure 7:
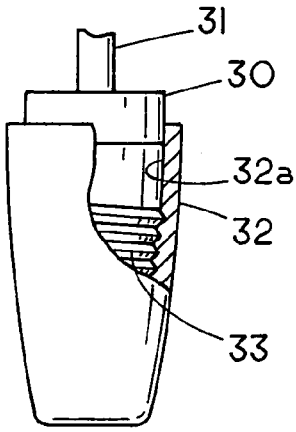
FIG. 7 is a sectional view of a holder engaging the open end of a twist-on wire connector.
Figure 8:
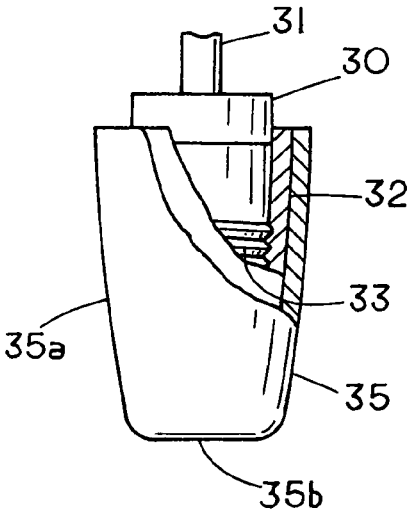
FIG. 8 is a sectional view of the holder of FIG. 7 after dip-molding the twist-on wire connector of FIG. 7 in a vat of dip-moldable material.

A reference to FIGS. 7-8 illustrates the in-situ formation of an insulated housing on the exterior rigid shell 32 of a ready to use twist-on electrical connector. In this method a hanger bar 31 includes a mandrel comprising an expandable plug 30 frictionally engaging the interior surface 32*a* on the open end of the electrical connector shell 32. The twist-on electrical connector includes a wire coil 33 in the lower end of the connector 32.

FIG. 8 is a partial sectional view showing the twist-on wire connector 32 of FIG. 5 after the connector has been dip-molded in the vat of dip-molded material such as liquid plastic for in-situ formation of an outer or shell housing 35 that conforms and adheres to the exterior of the twist on wire connector 32. Shell 35 is formed by extending the housing 32 sufficiently into the vat of dip-moldable material to form the dip-molded shell 35 that completely encapsulates a circumferential side surface 35*a* of the rigid housing 32 as well as the end surface 35*b*.

Once the shell 35 had been formed through a process of dip-molding the expandable plug 30 is removed leaving a twist-on wire connector 32 with an in-situ formed shell 35 that surrounds the twist-on wire connector to provide enhanced impact resistant to the connector 32. Thus, the method of making an impact resistance twist-on wire connector comprises the steps of, securing a twist-on wire connector 32 having a rigid housing to a mandrel 30, dipping the mandrel with the twist-on wire connector having a rigid housing in a vat of liquid plastic, allowing the liquid plastic to solidify and form an in-situ dip-mold shell 35 around an eternal surface of the twist-on wire connector 32; and removing the mandrel from the twist-on wire connector to provide an in-situ formed dip-molded covering 35 around the rigid housing of the twist-on wire connector to provide enhanced impact resistance to the twist-on wire connector.

Figure 8A:
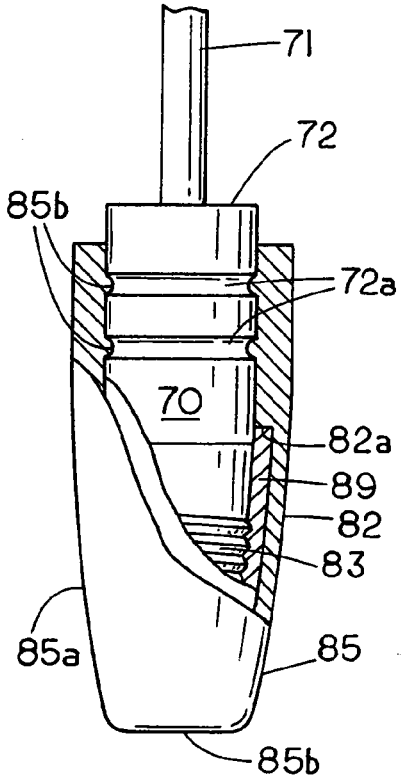
FIG. 8*a* is a sectional view of a twist-on wire connector housing with a sealant chamber.

FIG. 8A shows a sectional view of an alternate embodiment of a twist-on wire connector 89 with a dip molded shell 85 having a sealant chamber 70. The connector 89 has been dip-molded in the vat of dip-molded material such as liquid plastic for in-situ formation of an outer or shell housing 85 that conforms and adheres to the exterior of the twist-on wire connector 89. Shell 85 is formed by extending the wire connector housing 89 sufficiently into the vat of dip-moldable material to form the dip-molded shell 85 that has a circumferential side 85*a* that completely encapsulates a circumferential side surface of the twist-on wire connector 89 and an end surface 85*b* that covers an end of twist-on wire connector 89. In the embodiment of FIG. 8A, top sealant chamber 70 has been formed by use of a mandrel 72 that extends downward from support rod 71. The lower end of mandrel 72 has a smaller diameter than the top end of wire connector 89 so that there is formed an annular lip 82*a* that holds the twist-on wire connector in place. Mandrel 72 includes a pair of recesses 72*a* that form annular protrusions 85*b* for use with a cover or the like.

Figure 9:
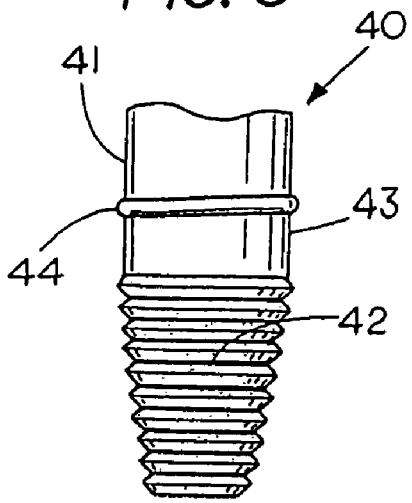
FIG. 9 is an elevation view of a mandrel having a surface in the shape of a spiral thread.
Figure 10:
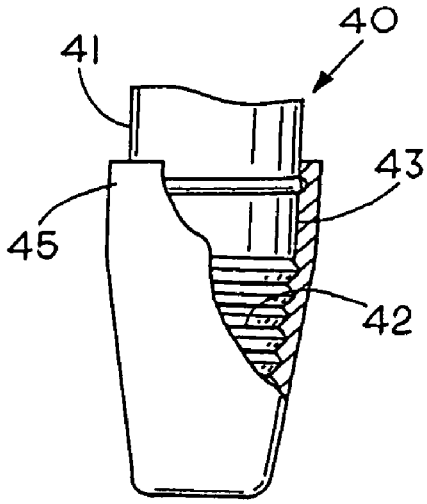
FIG. 10 is a sectional view of the mandrel of FIG. 9 with a layer of dip-molded material extend around the mandrel.
Figure 11:
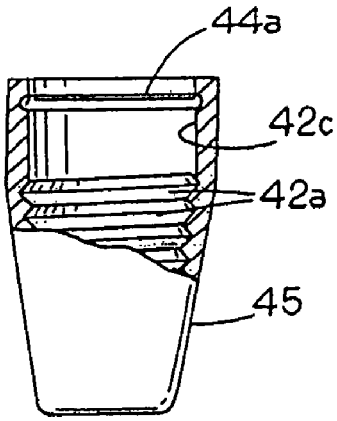
FIG. 11 is a sectional view showing a dip-molded shell of FIG. 10 with the mandrel removed to reveal an interior shell surface having a spiral thread to allow one to insert a wire coil therein to produce a twist-on wire connector with a single dip-molded shell.

FIG. 9-11 shows the process of forming a dip-molded hollow shell for receiving a wire coil to allow one to form a twist on wire connector housing through a dip-molding process. FIG. 9 shows the mandrel 40 having a hanger bar 41 a top circular flange 40 a cylindrical shaft 43, an annular bead 44 and a bottom portion 42 having the shape of an exterior surface of a wire coil.

FIG. 10 is a partial sectional view showing the mandrel 40 after removal from vat of dip-moldable material comprises molten plastic such as plastisol to have a layer of in-situ formed dip-molded plastic 45 encasing mandrel 40.

Once the dip-molded coating 45 has solidified the mandrel 40 is removed to leave a shell 35 having an open end. FIG. 11 shows the dip-molded shell 45 partially in section to reveal the annular recess 44*a* for use in engaging a cover, if so desired, located on one end of internal surface 42*c* and a set of spiral recess 42*a* for frictionally engaging a wire coil located on the other end of internal surface 42*c*.

Figure 12:
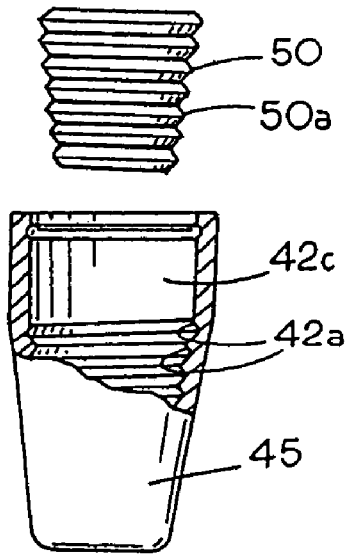
FIG. 12 shows the dip-molded shelled partially in section positioned proximate a twist-on wire coil.

FIG. 12 shows the dip-molded shell 45 positioned proximate a conventional wire coil 50 having a spiral thread for use in twist-on wire connector. The male spiral threads 50*a* on the wire coil are sized so as to frictionally engage the female threads 42*a* in the housing 45 as one rotates the wire coil 50 into the bottom of the housing.

Figure 13:
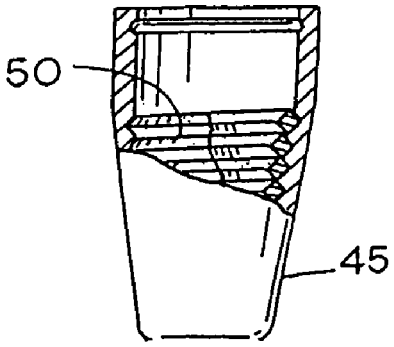
FIG. 13 shows a partial sectional view of a twist on wire connector with a dip-molded shell.

FIG. 13 shows the wire coil 50 in frictional engagement with the interior of the dip-molded housing 45 to provide a twist-on wire connector with a dip-molded housing. While the wire coil is shown as being frictionally held in dip-molded housing other means of securing such as use of adhesives or the like or mechanical linking could be used.

Thus the embodiments of FIGS. 9-13 show a method of making a twist-on wire connector with enhanced impact resistance comprising the steps of forming a mandrel 40 having an external surface in the shape of a spiral male thread 42, dipping the mandrel 40 in a vat of dip-moldable material 45 on the mandrel 40, removing the mandrel 40 with the dip-moldable coating 45 from the vat, allowing the dip-molded coating to solidify on the mandrel to form a dip-molded shell around the mandrel, removing the mandrel from the dip-molded shell to thereby leave a hollow dip-molded shell 45 with a spiral female thread 42*a* located on an interior surface of the dip-molded shell. One can then insert a twist-on wire coil 50 with a male spiral thread 50*a* into the spiral female thread 421 in the dip-molded hollow shell 45 to form a twist-on wire connector with the dip-molded shell providing enhanced impact resistance.

We claim:

1. A twist-on wire connector having enhanced impact resistance comprising;

a spiral wire coil having an internal surface with a female spiral thread and an external surface with a male spiral thread; and a one-piece dip-molded shell having a female thread for mating with the male spiral thread of the wire coil for retaining the wire coil therein comprising a layer of shock absorbing insulating material, said shock absorbing insulating material comprising a soft-to-the-touch non-slip dip-moldable material having a shape conforming to an external surface of the male spiral thread to thereby cushion any impact to the twist-on wire connector, said dip-molded shell extending radially past an end of the wire coil.

2. A twist-on wire connector having enhanced impact resistance comprising;

a rigid housing having an interior surface and an exterior surface;

a wire engaging member located on said interior surface of the rigid housing; and a soft-to-the-touch, non-slip, one-piece dip-molded shell secured to and entirely covering the exterior surface of the rigid housing with the dip-molded shell softer than the rigid housing to thereby provide a twist-on wire connector with enhanced impact resistance, said dip-molded shell having an internal surface shape and an annular lip for retaining the rigid housing therein, said soft-to-the-touch, non-slip, dip-molded shell extending radially past an end of the rigid housing and the annular lip.

3. The twist-on wire connector of claim 2 wherein the dip-molded shell comprises plastisol.

4. The twist-on wire connector of claim 2 wherein the dip-molded shell has a thickness of at least 0.020 inches.

5. The twist-on wire connector of claim 2 wherein the dip-molded shell upon solidification has a durometer of less than 80.

6. The twist-on wire connector of claim 2 including radially inward extending pie shaped segments that are circumferentially spaced from each other.

7. The twist-on wire connector of claim 2 including a sealant chamber located proximate an end of the twist-on wire coil.

8. The twist-on wire connector of claim 2 including compressible air pockets on the housing of the wire connector to thereby provide a wire connector with enhanced comfort grip.

* * * * *